United States Patent [19]

Spector

[11] Patent Number: 4,899,395

[45] Date of Patent: Feb. 13, 1990

[54] CONCEALABLE, SELF-SUFFICIENT POCKET

[76] Inventor: Donald Spector, 380 Mountain Road, Union City, N.J. 07087

[21] Appl. No.: 327,684

[22] Filed: Mar. 23, 1989

[51] Int. Cl.[4] ..... A41D 27/20

[52] U.S. Cl. ..... 2/250; 2/247; 2/249; 2/252

[58] Field of Search ..... 2/247, 248, 249, 250, 2/251, 252, 244

[56] References Cited

U.S. PATENT DOCUMENTS

| | | | |
|---|---|---|---|
| 2,908,982 | 10/1959 | Corley | 2/247 |
| 3,537,108 | 11/1970 | Daniels | 2/247 |
| 3,611,444 | 10/1971 | Rector | 2/247 |
| 4,218,781 | 8/1980 | Lieberman | 2/247 |
| 4,389,801 | 6/1983 | Sharrock et al. | 2/247 X |
| 4,602,390 | 7/1986 | Morera et al. | 2/251 |

*Primary Examiner*—Werner H. Schroeder
*Assistant Examiner*—Jeanette E. Chapman
*Attorney, Agent, or Firm*—Michael Ebert

[57] ABSTRACT

A self-sufficient pocket for concealing a small item, the pocket being attachable to the inner surface of an undergarment or garment where it is accessible only to the wearer thereof. The pocket is composed of a rectangular back sheet marginally sealed to a larger rectangular front sheet except at the top side to leave a top entry to form an open pocket for receiving the item. The back sheet is centered with respect to the front sheet to define a frame-like border thereon which is coated with a layer of pressure-sensitive adhesive. When the loaded pocket is pressed against the inner surface of the garment, this action also serves to close the pocket. When the pocket is thereafter stripped off the garment, the pocket is then open and the item can be removed from the pocket.

5 Claims, 1 Drawing Sheet

Fig. 1.
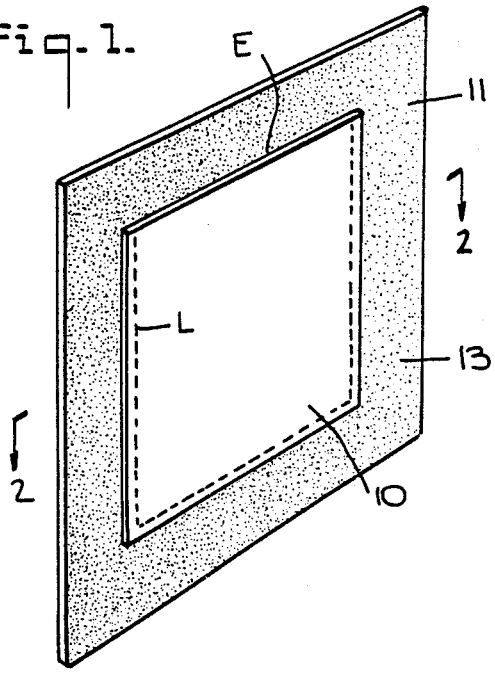
Fig. 4.
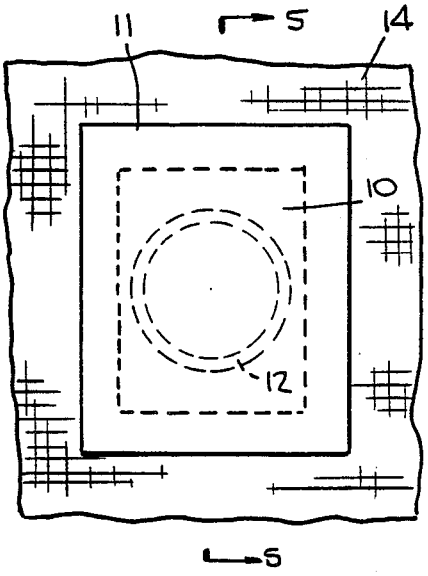
Fig. 2.
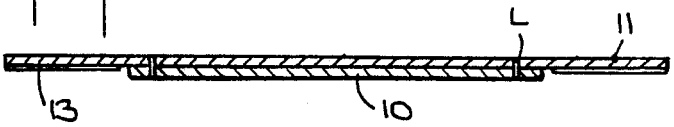
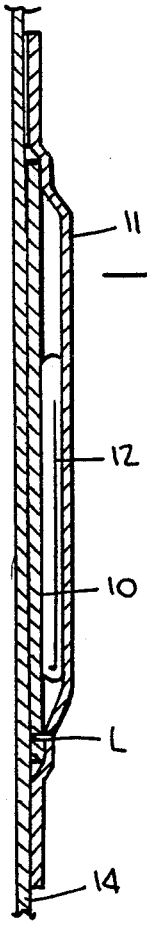
Fig. 5.
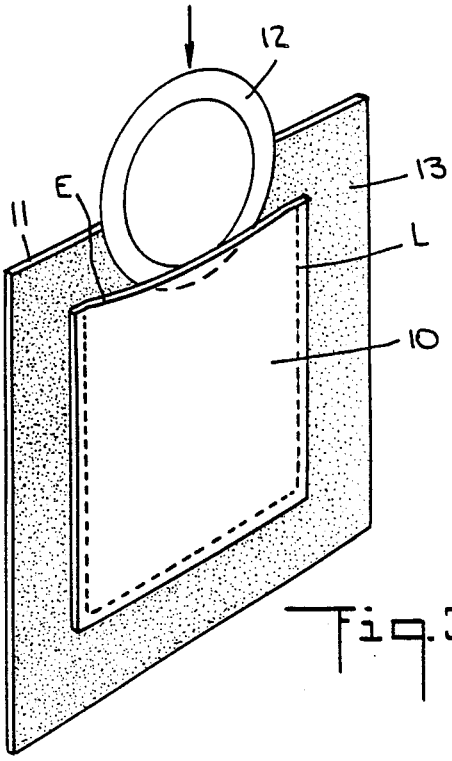
Fig. 3.

CONCEALABLE, SELF-SUFFICIENT POCKET

BACKGROUND OF INVENTION

1. Field of Invention

This invention relates generally to secret pockets on garments for concealing small items, and more particularly to a self-sufficient open pocket which when loaded is adherable to the inner surface of the garment where it is accessible only to the wearer, the pocket when so adhered being closed.

2. Status of Prior Art

Men's garments are usually provided with open pockets in the trousers and jacket which the wearer more or less loads with a wallet, a key purse, a change purse and other items to be carried on the person. While clothing pockets are now commonplace, they have had a relatively short history; for prior to this innovation, small items were stored in enlarged cuffs or in hand-carried purses or pouches.

The invention of the pocket was followed not long after by the introduction of the pickpocket skilled in stealing from pockets without the wearer of the garment being aware that this was happening. But pickpockets represent a relatively benign class of robbers, for the modern mugger makes it a practice to physically attack his victim before stripping his pockets.

It is because of the danger of theft that many articles of apparel today are provided with secret pockets which are so placed as to render them less accessible than conventional pockets. Thus a jacket, in addition to the usual outer pockets and inner breast pocket, may include a small secret pocket elsewhere in the jacket or even within a breast pocket. The location of the secret pocket is hopefully such that it would normally escape a pickpocket or mugger's attention. Also, so-called "money belts" are designed so as to provide a secret pocket within the belt.

The loss of a wallet often involves more than the loss of folding money, for most individuals also carry in their wallet one or more credit cards. If, therefore, the wallet is stolen, the victim is deprived not only of his cash, but also of his credit cards. This loss can be serious when the victim is on a trip and depends on his credit cards to pay his hotel bill and to purchase goods and services. Typically, the modern traveller carries a minimum amount of cash and depends on his credit cards for most payments.

Women's apparel is normally without pockets, and women carry cosmetics, money, credit cards and other small items in their purse, the theft of which represents a total loss. The modern woman will often also carry in her purse, a prophylactic sheath or condom as a protective measure in the event of a sexual encounter.

The need exists, therefore, in the case of both men and women, for a secret pocket that can be placed on a garment or undergarment where it is accessible only to the wearer.

SUMMARY OF INVENTION

In view of the foregoing, the main object of this invention is to provide a self-sufficient pocket for concealing small items, such as a credit card, folding money or a prophylactic sheath on the inner surface of a garment or undergarment.

More particularly, an object of this invention is to provide a self-sufficient pocket of the above type which is adherable to the inner surface of a garment or undergarment, and which when so attached, closes the pocket to prevent the loss of the item stored therein.

Also an object of the invention is to provide a pocket formed of low-cost, soft, fabric-like material which, when attached, conforms to the inner surface of an undergarment or garment, and is comfortable to wear. Because the pocket is inexpensive, it is disposable after a single use.

Briefly, stated, these objects are attained in a self-sufficient pocket for concealing a small item, the pocket being attachable to the inner surface of an undergarment or garment where it is accessible only to the wearer thereof. The pocket is composed of a rectangular back sheet marginally sealed to a larger rectangular front sheet except at the top side to leave a top entry to form an open pocket for receiving the item. The back sheet is centered with respect to the front sheet to define a frame-like border thereon which is coated with a layer of pressure-sensitive adhesive. When the loaded pocket is pressed against the inner surface of the garment, this action also serves to close the pocket. When the pocket is thereafter stripped off the garment, the pocket is then open and the item can be removed from the pocket.

BRIEF DESCRIPTION OF DRAWINGS

For a better understanding of the invention as well as other objects and further features thereof, reference is made to the following detailed description to be read in conjunction with the accompanying drawings wherein:

FIG. 1 is a perspective view of a concealable, self-sufficient pocket in accordance with the invention;

FIG. 2 is a transverse section taken in the plane indicated by line 2—2 in FIG. 1;

FIG. 3 shows the pocket after being loaded with an item to be concealed;

FIG. 4 shows the pocket after it has been attached to the inner surface of a garment or undergarment; and FIG. 5 is a longitudinal section taken in the plane indicated by line 5—5 in FIG. 4.

DESCRIPTION OF INVENTION

Referring now to FIGS. 1 to 3, a concealable pocket in accordance with the invention is composed of a small rectangular back sheet 10 marginally sealed on all sides by seam line L, except at the top side, to a larger rectangular front sheet 11. The unsealed top side leaves a top entry E to form an open pocket for receiving a small, relatively flat item 12.

Back sheet 10 is centered with respect to front sheet 11 so that the area surrounding the back sheet defines a frame-like border. This border is coated with a pressure-sensitive adhesive layer 13.

Sheets 10 and 11 may be formed of high-strength paper, in which case sealing line L is a glue line. Preferably, sheets 10 and 11 are formed of non-woven fabric material such as non-woven, spun-laced fabrics which are soft and drapable. Suitable for this purpose are the "Sontara" polyester blends produced by duPont. This non-woven fabric is durable and will not tear or abrade, and is fusable when subjected to ultrasonic energy. It also meets federal standards for non-flammability, it is non-allergenic as well as heat sterilizable.

Ultrasonic welding may be used to weld together the non-woven fabric sheets 10 and 11 on line L. This is accomplished by interposing the sheets between a "sonotrode" horn and an anvil. The horn is excited into vibration at an ultrasonic frequency and the ultrasonic energy is transformed into heat which softens the thermoplastic sheets and causes them to fuse together. The amount of heat generated is controlled by the adjustable amplitude of ultrasonic vibration.

After the open pocket is loaded by item 12 which may be a credit card, folding money or a prophylactic sheath, it is then attached, as shown in FIG. 4, to the inner surface of an undergarment or garment 14. The pressure-sensitive adhesive border 13 is pressed against the surface to conform the pocket to the fabric. As a consequence of this action, the entry E, which extends along the inner edge of the upper branch of the border, is closed and item 12 is then locked in the pocket.

The placement of the pocket is determined by the wearer, the site chosen being such as to render the pocket accessible only to the wearer. Thus in the case of a man's jacket, the pocket may be placed on the interior between the shoulders, so that even when the jacket is open, the secret pocket is not visible and is accessible only after the jacket is taken off. And in the case of a woman, the secret pocket may be attached to the inner surface of the waist of a skirt or of an undergarment.

Where the pocket is intended for a credit card, it can be dimensioned to snugly receive this card, and where it is intended for a packaged condom, it may be dimensioned to snugly receive this package. When the wearer of the pocket wishes to obtain access to the item stored therein, the wearer has only to strip the pocket off the fabric surface onto which it is attached. In doing so, the pocket is again open and the item may be removed therefrom.

While there has been shown and described a preferred embodiment of a concealable, self-sufficient pocket in accordance with the invention, it will be appreciated that many changes and modifications may be made therein without, however, departing from the essential spirit thereof. Thus the pocket may be provided with a peel-off cover sheet of the same size as the front sheet which is adhered to the border of the front sheet to shield the adhesive layer until such time as the pocket is put to use.

I claim:

1. A self-sufficient pocket for concealing a small item, the pocket being attachable to the inner surface of an undergarment or garment where it is accessible only to the wearer thereof, said pocket comprising:

(a) a rectangular back sheet;

(b) a larger rectangular front sheet, said back sheet being centered with respect to the front sheet and being marginally sealed thereto on all sides except for the top side to leave a top entry to form an open pocket for receiving the item, the margin on the front sheet surrounding the back sheet defining a frame-like border; and (c) a layer of pressure-sensitive adhesive on the border, whereby after the open pocket is loaded with the item, the pocket may then be pressed against said inner surface and conformed thereto to close the pocket.

2. A pocket as set forth in claim 1, wherein the open pocket is dimensioned to snugly receive a standard credit card.

3. A pocket as set forth in claim 1, wherein said pocket is dimensioned to snugly receive a packaged prophylactic sheath.

4. A pocket as set forth in claim 1, wherein said sheets are formed of high-strength paper and said back sheet is marginally glued to said front sheet.

5. A pocket as set forth in claim 1, wherein said sheets are formed of non-woven fabric thermoplastic material and said back sheet is ultrasonically sealed to said front sheet.

* * * * *